US006257661B1

(12) United States Patent
Eberle

(10) Patent No.: US 6,257,661 B1
(45) Date of Patent: Jul. 10, 2001

(54) WORK CHAIR

(75) Inventor: Emil Eberle, Rehetobel (CH)

(73) Assignee: Provenda Marketing AG, Rehetobel (CH)

( * ) Notice: Subject to any disclaimer, the term of this patent is extended or adjusted under 35 U.S.C. 154(b) by 0 days.

(21) Appl. No.: 09/421,034

(22) Filed: Oct. 20, 1999

(30) Foreign Application Priority Data

Oct. 21, 1998 (CH) ..... 2120/98

(51) Int. Cl.[7] ..... A47C 7/62
(52) U.S. Cl. ..... 297/188.2
(58) Field of Search ..... 297/188.01, 188.14, 297/188.18, 188.19, 188.2, 217.1, 115, 440.1, 188.21

(56) References Cited

U.S. PATENT DOCUMENTS 3,042,467 7/1962 Germick ..... 311/17
3,271,070 * 9/1966 Dlouhy et al. .
4,339,061 7/1982 Dunn ..... 224/42.42
5,865,503 * 2/1999 Shields, Jr. .
5,997,081 * 12/1999 Kayumi .
6,142,559 * 11/2000 Sorel et al. .

FOREIGN PATENT DOCUMENTS 4423684 4/1996 (DE) .
2489123 3/1982 (FR) .

* cited by examiner

*Primary Examiner*—Milton Nelson, Jr.
(74) *Attorney, Agent, or Firm*—Wiggin & Dana

(57) ABSTRACT

A work chair has columnar armrest carriers, which normally serve for the uptake of an armrest. On at least one side of the work chair, however, armrest carrier bears a handbag instead of an armrest. This handbag has a pocket, for example, in which the armrest carrier can be engaged. Alternatively, an armrest or an armrest carrier may be provided with features for carrying a handbag, portable telephone or the like.

7 Claims, 6 Drawing Sheets

WORK CHAIR

BACKGROUND OF THE INVENTION (1) Field of the Invention

The invention relates to work chairs.

(2) Description of the Related Art

In certain work spaces, there are no storage surfaces present, or they are very scant, so that there is no space for storing private items, such as handbags. If these are placed on the floor, then there is the danger of damage or contamination. Also, in operations that require close concentration over long periods of time, such as, for example, stock-market trading using a computer and monitor, it has often proven very troublesome if the handbag cannot be reached in a practically blind manner, in order to retrieve a handkerchief, for example. The same is true also, if one must move for short distances in the work chair in order to operate, for example, different equipment.

BRIEF SUMMARY OF THE INVENTION

The present invention can make it possible for the user of a work chair to comfortably retrieve a handbag and its contents in a variety situations. This may be possible in a practically blind manner, if, for example, one must continually keep his eyes directed to a computer screen.

Accordingly to on aspect of the invention, in the case of a work chair with armrest carrier, the armrest or the armrest carrier bears a handbag. This has the advantage that during work, the handbag is always found in an easily accessible place for the person seated in the chair and is also securely stored there, so that a one-handed operation (e.g., accessing items in the handbag) is possible, for example when the person makes a telephone call.

The handbag can either be attached to the armrest itself or, instead of the armrest, to the armrest carrier. If the handbag is arranged on an armrest carrier instead of the armrest, then the armrest carrier may appropriately be shaped like a column. This makes it possible to attach the handbag in a simple way to the armrest carrier. For this purpose, the handbag may have an uptake (e.g., a compartment extending upward from an open lower end to a closed upper end) for receiving the armrest carrier. For example, a pocket (e.g., formed in the fabric of the handbag) can serve as the uptake, in which the armrest carrier can be engaged. Such a pocket can be manufactured at little cost. However, it is also possible that the handbag has an opening in the bottom and an insert is provided, for example made of plastic, which has an uptake for the armrest carrier. The insert may be, for example, angular, U-shaped or trough-shaped. A U-shaped or trough-shaped configuration is appropriate if the handbag will also serve as the armrest. In this case, the insert gives the handbag the necessary rigidity and stability.

Appropriately, the uptake for the armrest carrier may be arranged crosswise to the longitudinal direction of the handbag. If more free space is desired laterally for the user, the uptake for the armrest carrier can also be arranged parallel to the longitudinal direction of the handbag.

If the handbag is arranged next to an armrest, then a coupling part may be arranged on the armrest or armrest carrier, which cooperates with a coupling part on the handbag, such that the handbag can be suspended on the armrest or the armrest carrier. The coupling part on the chair, for example, may comprise a prismatic part (e.g., a circular cylindrical part) aligned approximately perpendicular to the base of the chair. The prismatic part is joined by means of a crosspiece with the armrest or the armrest carrier, whereby the crosspiece is also aligned perpendicular to the base of the chair and is narrower than the cross-sectional dimension of the prismatic part. A hollow shape corresponding to the prismatic part is formed on the coupling part on the handbag. The hollow shape has a slot for uptake on the crosspiece. The handbag can be attached to the chair by inserting the hollow shape of the coupling part on the handbag approximately perpendicular to the base of the chair via the coupling part on the chair, so that this hollow shape is engaged around the prismatic part. The slot, in which the crosspiece is then set, is narrower than the width of the prismatic part. In this way, the handbag can be attached to the chair resistant to twisting and can be removed from it at any time.

Advantageously, the coupling part sits on the back side of the handbag and has an introduction opening, which is the size of the prismatic part, underneath the slot.

Other embodiments for joining the handbag and chair are, e.g.,: an insertion tab on the handbag, with which the latter can be placed, e.g., on a belt; and an insertion pocket on the chair, in which the insertion tab can be inserted. A mobile telephone can also be suspended by such an insertion pocket.

Another possible coupling of the handbag and chair comprises engaging a strap-type carrier part in belt loops on the handbag.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
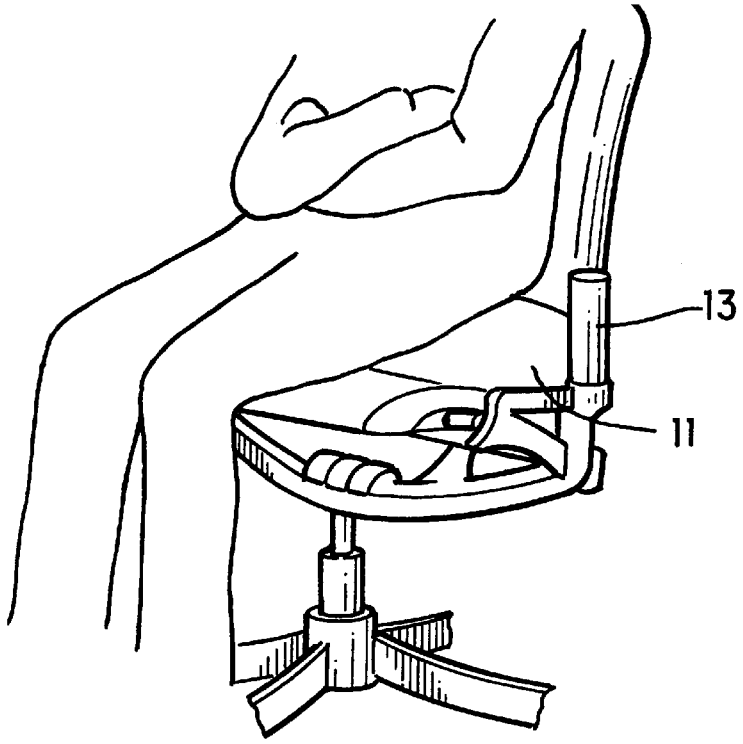
FIG. 1 shows a chair with armrest carrier.
Figure 2:
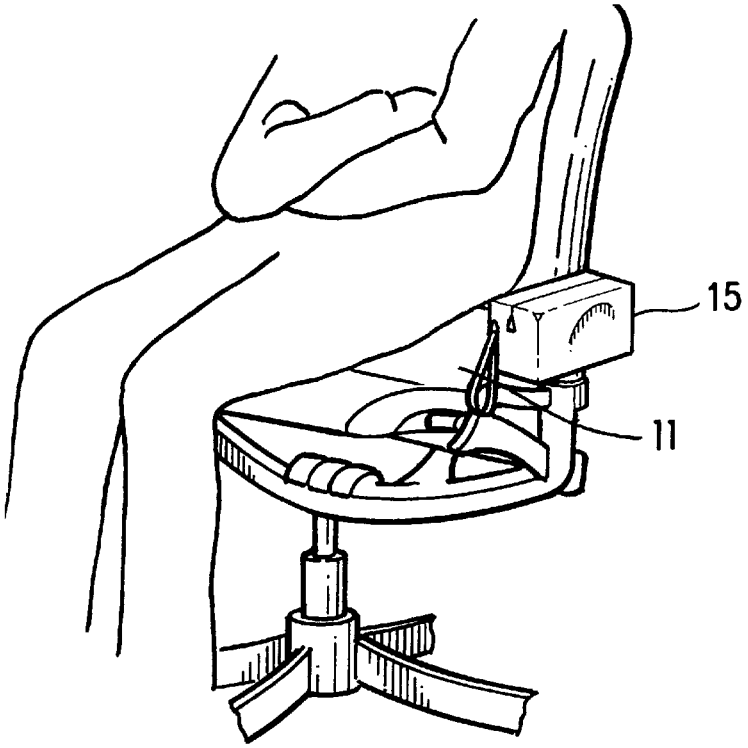
FIG. 2 shows the chair of FIG. 1 with handbag arranged on the armrest carrier.
Figure 3:
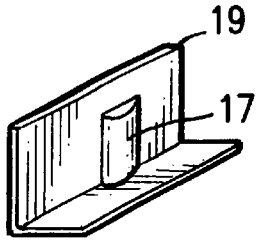
FIG. 3 shows an insertion part for the handbag according to FIG. 2.
Figure 6:
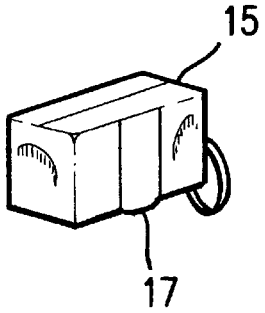
FIG. 6 shows the handbag of FIG. 2 viewed from the other side, whereby the pocket is visible, in which the armrest carrier may engage.
Figure 4:
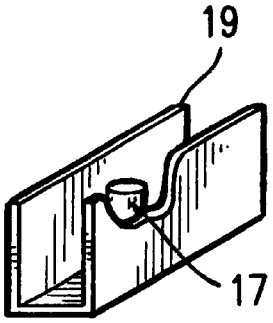
FIG. 4 shows a second form of embodiment of an insertion part.
Figure 5:
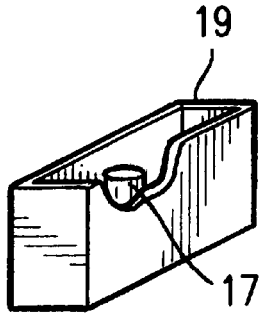
FIG. 5 shows a third form of embodiment of an insertion part.

The work chair shown in FIG. 1 has a columnar armrest carrier 13 on both sides of seat 11. The armrest carrier 13 may receive and support an armrest in a position for the seated user to rest his associated forearm on an upper surface of the armrest. As FIG. 2 shows, however, the chair bears a handbag 15 instead of a conventional armrest on at least one side. The handbag may comprise a cloth, leather, vinyl or other flexible or rigid body with one or more interior compartments accessible through opening(s) in the body which are closeable by zipper, snap, or other closures. The handbag may also have a carry-strap or handle. When installed on the carrier, the handbag may serve as an armrest, with its upper surface extending longitudinally in position to support the user's associated forearm. Handbag 15 has an uptake for engaging armrest carrier 13. This uptake, for example, can take the shape of a pocket 17 (FIG. 6). However, it can also have an opening on the bottom and an insertion part 19 (e.g., a rigid structural insert within the handbag) can be provided, which has an uptake 17 for the armrest carrier. A first example of embodiment of such an insertion part 19 of elbow configuration (L-shaped cross-section) is shown in FIG. 3. FIGS. 4 and 5 show a U-shaped or a trough-shaped insertion part 19.

Figure 7:
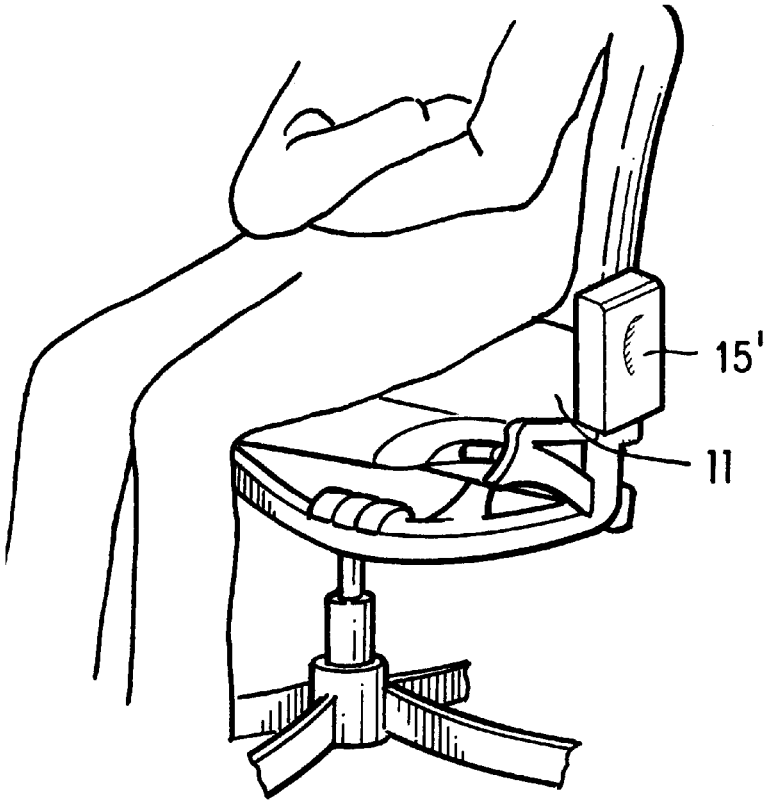
FIG. 7 shows another form of embodiment of the handbag.

In the case of the handbag shown in FIGS. 2 and 6, uptake 17 for armrest carrier 13 runs crosswise to the longitudinal direction (length) of the handbag. As FIG. 7 shows, however, uptake 17 for armrest carrier 11 may also be arranged parallel to the longitudinal direction of handbag 15'.

FIGS. 8 to 15 show examples of embodiments, in which a handbag 15 and an armrest are provided simultaneously on one or both sides of the chair. The handbag can thus be arranged on armrest 20 as in the example according to FIGS. 8 to 11. However, it may also be arranged on armrest carrier 11, as in the examples according to FIGS. 12 and 13 or 14 and 15. This arrangement is independent of the type of coupling between chair and handbag 15.

Figure 8:
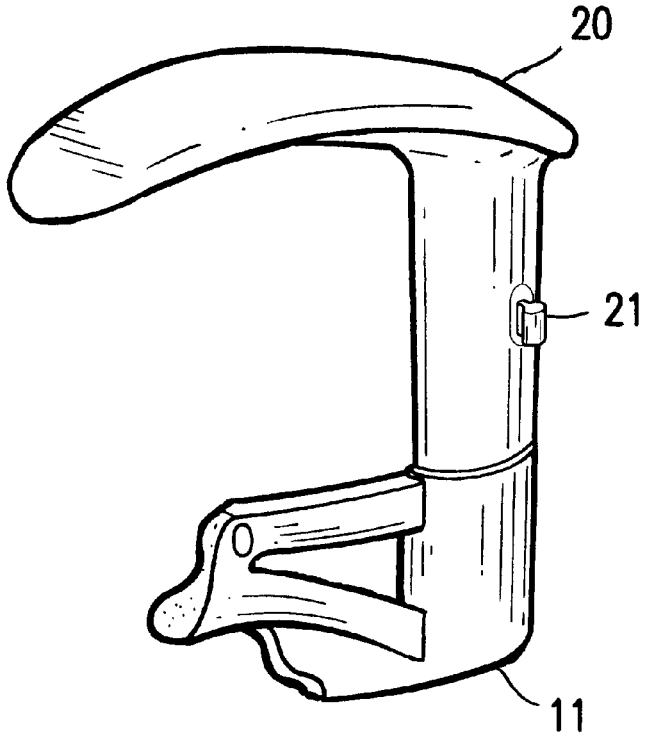
FIG. 8 shows an armrest with a prismatic unit as a coupling part.
Figure 9:
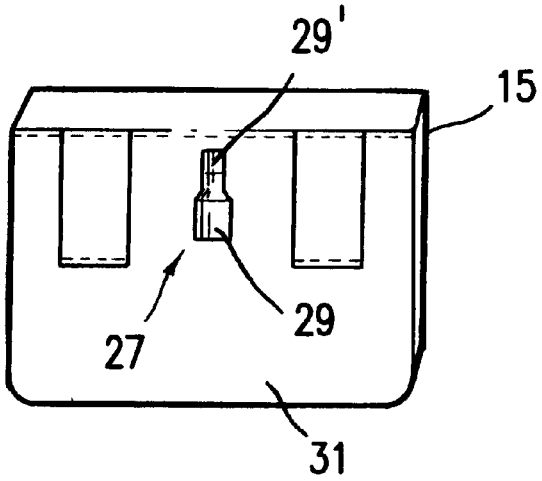
FIG. 9 shows a handbag with coupling part in the rear wall of the handbag adapted to the coupling part according to FIG. 8.
Figure 10:
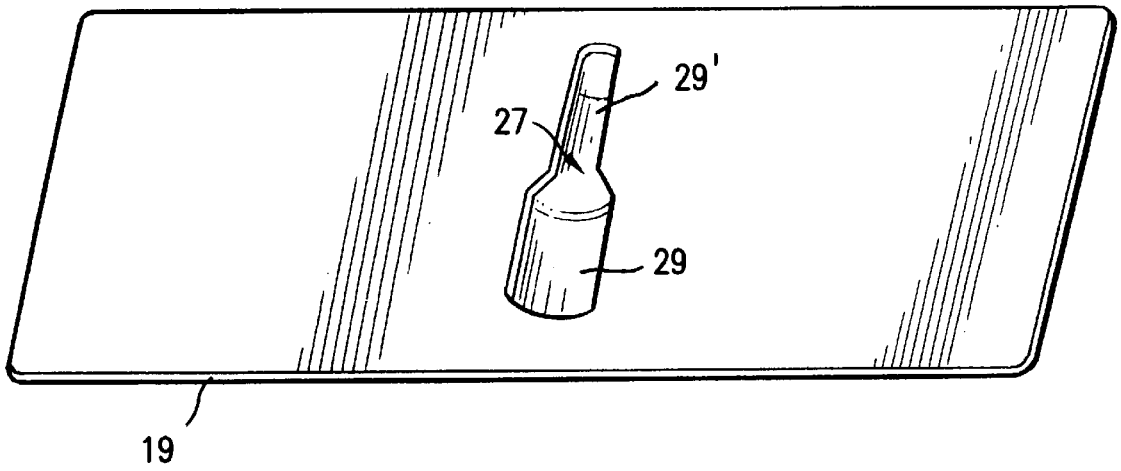
FIG. 10 shows an insertion part with a coupling part for insertion in the rear wall of a handbag according to FIG. 9.
Figure 11:
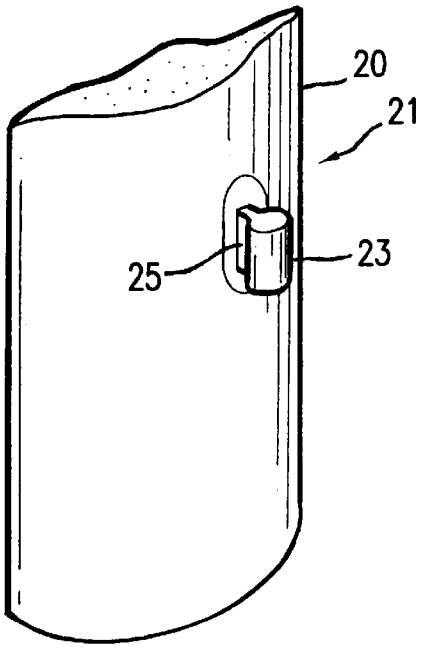
FIG. 11 shows a perspective diagram of the coupling part on the armrest.

A height-adjustable armrest 20 on an armrest carrier 11 is shown in FIG. 8. A coupling part 21 is formed on the armrest. The coupling part 21, as is better visible in FIG. 11, is comprised of a cylindrical head 23, which is spaced-apart by a crosspiece 25 from armrest 20. Head 23 is advantageously aligned vertically, but can also be arranged in an oblique or horizontal direction. Handbag 15 has an opening (keyhole) of a coupling part 27 on its back side. This opening has a lower region 29, which has dimensions corresponding to head 23, and an upper region 29', which has dimensions corresponding to crosspiece 25. The actual coupling part 27, which forms a cylindrical hollow shape, is arranged behind the slot-type upper region 29' of the opening. Head 23 is introduced into the lower region of the opening of coupling part 27 on the handbag when handbag 15 is suspended on armrest 20, and then the handbag moves downward, so that head 23 reaches into the cylindrical hollow shape of coupling part 27, interlocking the handbag to the carrier against movement of the handbag in all but an upward direction.

A rigid insertion part 19 made of plastic is incorporated rear wall 31 of handbag 15 for this purpose. The described coupling part 27 is formed in insertion part 19 shown in FIG. 10. The coupling part 21 on the outboard side of the armrest, as is shown in FIG. 11, is inserted into armrest 20 as a separate part.

Figure 12:
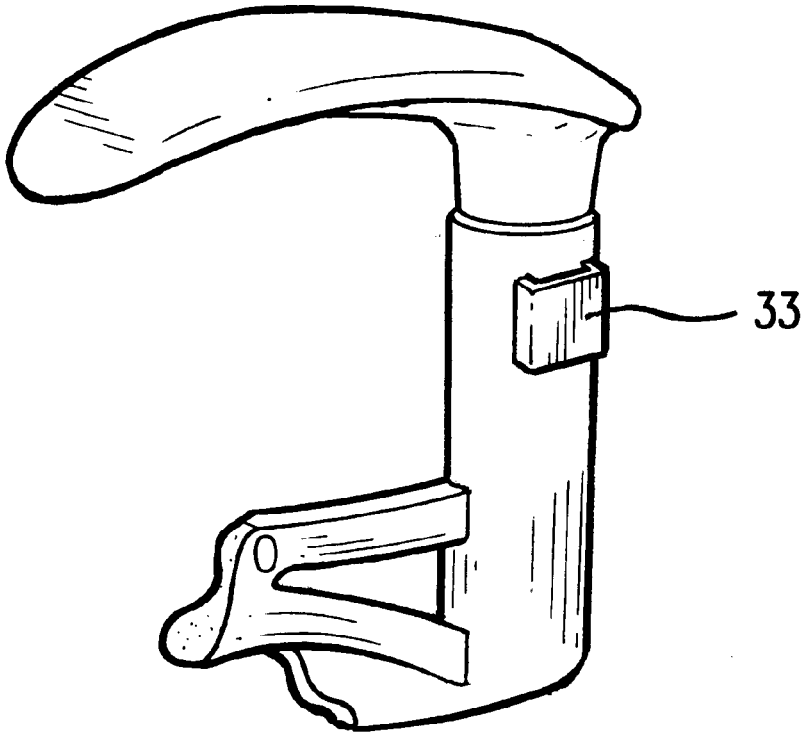
FIG. 12 shows a diagram of an armrest with an insertion pocket on the armrest carrier.
Figure 13:
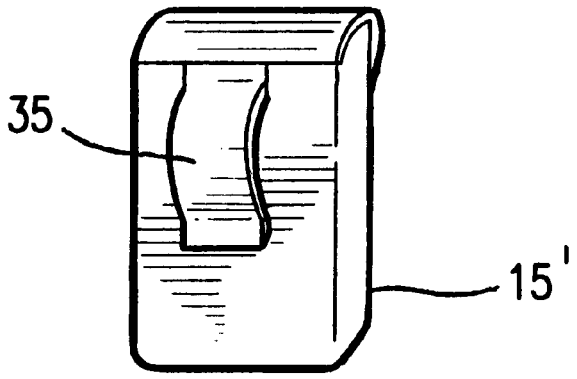
FIG. 13 shows a handbag with an insertion tab for inserting into the insertion pocket according to FIG. 12.
Figure 14:
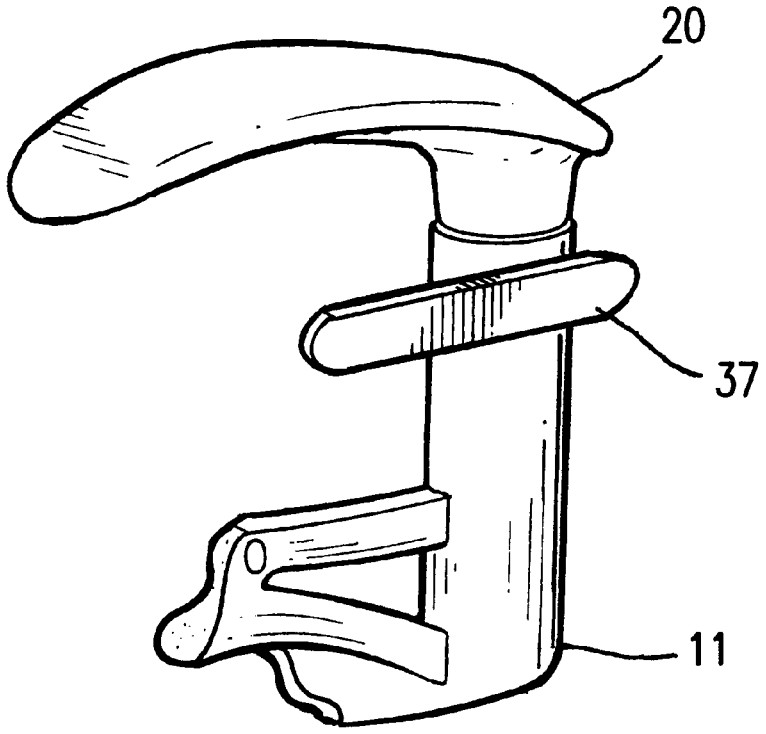
FIG. 14 shows a diagram of an armrest with a horizontal bar on the armrest carrier.
Figure 15:
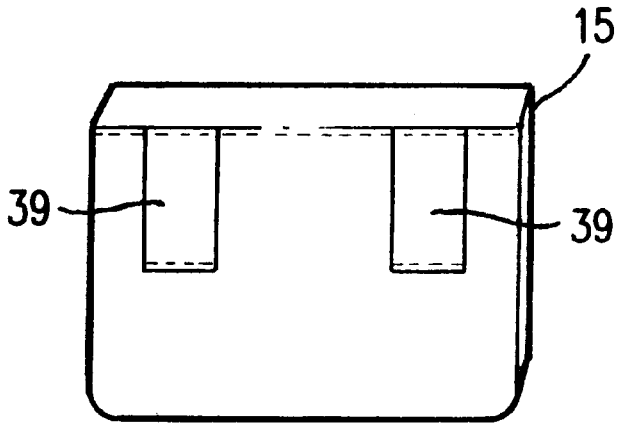
FIG. 15 shows a handbag with belt loops, which can be looped onto the bar according to FIG. 14.

Alternatively, a pocket or loop 33 defining a vertically-extending aperture for hooking on a downwardly extending insertion tab 35 of a mobile telephone or a handbag 15' can be provided on the chair, as is shown, for example, according to FIGS. 12 and 13, on either armrest carrier 11 or on the armrest 20 itself. Another possibility for suspending a handbag 15 on a chair consists of providing a horizontal rod 37 on armrest 20 or armrest carrier 11 according to FIGS. 14 and 15, over which belt loops 39 on handbag 15 can be attached. Also, it is conceivable to provide one or more snap fasteners or hook and loop fasteners on the handbag mateable with corresponding fasteners on the armrest carrier.

One or more embodiments of the present invention have been described. Nevertheless, it will be understood that various modifications may be made without departing from the spirit and scope of the invention. Accordingly, other embodiments are within the scope of the following claims.

What is claimed is:

1. A chair comprising:

a generally horizontal seat for supporting a seated user;

a generally vertical backrest;

a support for supporting the seat above a floor surface;

a vertically-extending projection carried by at least one of an armrest and an armrest carrier of the chair, engageable via a generally vertical translation to a complementary channel of a handbag for removeably securing the handbag to the chair in an installed position proximate at least at one side of the seated user.

2. The chair of claim 1 wherein said generally vertical translation comprises a generally downward movement of the handbag from an uninstalled position to the installed position, in which installed position the projection prevents disengagement of the handbag from the chair except by a generally upward movement of the handbag.

3. A handbag for installation on the chair of claim 1 and having a closeable opening to a compartment within the handbag, which compartment is accessible to the seated user with the handbag in the installed position.

4. A work chair with an armrest carrier (11) on a side of the chair, wherein said armrest carrier (11) removeably bears a handbag in absence of an armrest separate from the handbag on said side of the chair, the handbag having a bottom and an opening in the bottom and including a plastic insert, which insert has a vertically-extending channel for receiving a complementary portion of the armrest carrier.

5. The work chair of claim 4, wherein the insert has a cross-section selected from the group consisting of L-shaped and U-shaped.

6. A work chair with at least one of an armrest carrier (11) and an armrest (20) on a side of the chair, wherein:

said at least one of an armrest carrier (11) and an armrest (20) removeably bears a handbag;

a coupling part is provided on said at least one of an armrest and an armrest carrier, for removeably attaching said handbag; and said coupling part has a prismatic unit arranged on a crosspiece, and a second coupling part on said handbag has a hollow shape complementary to the prismatic unit, which second coupling part can be placed on the prismatic unit.

7. A work chair with an armrest carrier (11) on a side of the chair, wherein said armrest carrier (11) removeably bears a handbag in absence of an armrest separate from the handbag on said side of the chair, the handbag including a rear wall which faces inward when installed on the armrest carrier and wherein the handbag includes a first coupling part either in or on a rear wall of the handbag for detachably engaging a second coupling part on the armrest carrier and the first coupling part is integrated with a rigid insert in at least the rear wall of the handbag.

* * * * *